US006482064B1

(12) United States Patent
Lund

(10) Patent No.: US 6,482,064 B1
(45) Date of Patent: Nov. 19, 2002

(54) ELECTRONIC TOY SYSTEM AND AN ELECTRONIC BALL

(75) Inventor: Henrik Hautop Lund, Odense C (DK)

(73) Assignee: Interlego AG, Baar (CH)

( * ) Notice: Subject to any disclaimer, the term of this patent is extended or adjusted under 35 U.S.C. 154(b) by 72 days.

(21) Appl. No.: 09/630,770

(22) Filed: Aug. 2, 2000

(51) Int. Cl.[7] ..... A63H 30/00
(52) U.S. Cl. ..... 446/175; 446/485
(58) Field of Search ..... 446/175, 485, 446/484, 454, 456, 47; 463/39, 48–53; 273/148 D, 148 R, 108.1, 237; 345/156, 157, 158, 159, 161, 163, 166, 170

(56) References Cited

U.S. PATENT DOCUMENTS

| | | | | | |
|---|---|---|---|---|---|
| 1,943,685 | A | * | 1/1934 | Mayorga | 463/51 |
| 2,074,251 | A | * | 3/1937 | Braun | 446/175 |
| 2,849,819 | A | * | 9/1958 | Murphy et al. | 446/175 |
| 3,130,803 | A | * | 4/1964 | Wiggins | 446/175 |
| 3,314,189 | A | * | 4/1967 | Carroll | 446/175 |
| 3,406,481 | A | * | 10/1968 | Tachi | 446/175 |
| 3,500,579 | A | * | 3/1970 | Bryer | 446/175 |
| 4,232,865 | A | * | 11/1980 | Chen et al. | 273/311 |
| 4,307,538 | A | * | 12/1981 | Moffitt | 446/47 |
| 4,391,224 | A | * | 7/1983 | Adler | 446/175 |
| 4,487,583 | A | * | 12/1984 | Brucker et al. | 273/371 |
| 4,662,854 | A | * | 5/1987 | Fang | 446/175 |
| 4,702,718 | A | * | 10/1987 | Yanase | 446/175 |
| 4,737,134 | A | * | 4/1988 | Rumsey | 446/175 |
| 4,813,907 | A | * | 3/1989 | Rissman et al. | 446/175 |
| 4,828,525 | A | * | 5/1989 | Okano | 446/175 |
| 4,865,575 | A | * | 9/1989 | Rosenthal | 446/175 |
| 4,874,343 | A | * | 10/1989 | Rosenthal | 446/175 |
| 4,938,483 | A | * | 7/1990 | Yavetz | 446/175 |
| 5,054,778 | A | * | 10/1991 | Maleyko | 446/175 |
| 5,125,668 | A | * | 6/1992 | Welte | 446/456 |
| 5,169,156 | A | * | 12/1992 | Smollar | 273/312 |
| 5,319,531 | A | * | 6/1994 | Kutnyak | 446/47 |
| 5,452,901 | A | * | 9/1995 | Nakada et al. | 446/456 |
| D379,206 | S | * | 5/1997 | Meffert | 273/58 G |
| 5,692,946 | A | * | 12/1997 | Ku | 446/456 |
| 5,720,644 | A | * | 2/1998 | Ku | 446/175 |
| 5,723,855 | A | * | 3/1998 | Oh et al. | 446/444 |
| 5,741,185 | A | * | 4/1998 | Kwan et al. | 463/51 |
| 5,759,083 | A | * | 6/1998 | Polumbaum et al. | 446/435 |
| 5,989,091 | A | * | 11/1999 | Rodgers | 446/175 |

(List continued on next page.)

FOREIGN PATENT DOCUMENTS

| | | | | | |
|---|---|---|---|---|---|
| JP | 02172487 | A | * | 7/1990 | A63H/5/00 |
| JP | 03105415 | A | * | 5/1991 | G06F/3/033 |
| JP | 08066564 | A | * | 3/1996 | A63H/30/02 |
| JP | 2000079283 | A | | 3/2000 | |
| WO | WO 9221992 | A1 | * | 12/1992 | A63H/3/40 |

OTHER PUBLICATIONS

Lund, Henrik Hautop, et al., "RoboCup Jr. with LEGO Mindstorms".

*Primary Examiner*—Derris H. Banks
*Assistant Examiner*—Urszula M Cegielnik
(74) *Attorney, Agent, or Firm*—Pitney, Hardin, Kipp & Szuch LLP

(57) ABSTRACT

A toy system comprising a first toy element arranged to emit infrared light to its surroundings; a play face with a light reflection varying structurally over the play face; and a second toy element with means for moving the second toy element in response to detected infrared light and light reflection of the play face.

Moreover, a battery-operated electronic toy ball for use in an electronic toy system, comprising: infrared light emitters arranged spatially within the ball to emit infrared light to its surroundings, and wherein said emitters are turned on and off sequentially to avoid excessive battery drainage.

26 Claims, 5 Drawing Sheets

U.S. PATENT DOCUMENTS 6,007,401 A * 12/1999 Cyrus et al. ..... 446/175
6,068,537 A * 5/2000 Lupton ..... 446/456
6,110,000 A * 8/2000 Ting ..... 446/175
6,144,370 A * 11/2000 Eleyan et al. ..... 345/167
6,200,219 B1 * 3/2001 Rudell et al. ..... 273/148 B
6,217,025 B1 * 4/2001 Yamazaki et al. ..... 463/51
6,224,454 B1 * 5/2001 Cheng et al. ..... 446/175
6,248,019 B1 * 6/2001 Mudie et al. ..... 463/49
6,309,275 B1 * 10/2001 Fong et al. ..... 446/175
6,328,304 B1 * 12/2001 Lupton ..... 446/435
2002/0102910 A1 * 8/2002 Donahue et al. ..... 446/465

* cited by examiner

ELECTRONIC TOY SYSTEM AND AN ELECTRONIC BALL

This invention relates to an electronic toy system and an electronic toy ball.

In recent years electronic programmable toy systems have become very popular. This can for instance be seen at so-called robot-cup events where competitors build their own robots to compete in some discipline. A discipline could be a robot soccer game, where a competitor has to build a robot soccer player; another discipline could be robot obstacle race. Typically, these robot-cup events have been held by university organisations for university students or institutes. However, with the recent developments and commercialisations of electronic programmable toys such events are now arranged for kids. For this purpose especially construction toy systems with programmable elements are very popular, since a robot may be configured easily for one competition discipline, rebuilt, and used for another different discipline.

RELATED PRIOR ART

Japanese laid open patent application no 2000079283-A discloses an optical tracking device for toys. A transmitting unit e.g. in the form of a sphere has holes at equal intervals on its outer surface. Through each hole, an infrared ray signal produced by an infrared ray transmitter is transmitted externally. The transmitted signal is received by a receiver of a vehicle for straight running.

SUMMARY OF THE INVENTION

In a first aspect, the invention relates to an electronic toy system comprising: a first toy element arranged to emit infrared light to its surroundings; a play face with a light reflection varying structurally over the play face; and a second toy element with means for moving the second toy element, a first detector arranged to detect infrared light emitted from the first toy element, a second detector arranged to detect light reflection of a dot on the play face, and a control unit coupled to the detectors; wherein the control unit is to control the means to locate the first toy element and to navigate on the play face.

The use of a play face with a structurally varying light reflection, e.g. varied in visible grey tones or in colours, is used to set up a position system for navigating toy elements capable of sensing the light reflection of at least a dot on the play face. This in combination with the capability of sensing infrared light makes it possible to interact with toy elements emitting infrared light and to navigate on the play face in some pre-programmed way, thus bringing various robot interacting behaviours into the play.

In a second aspect, the invention relates to a battery-operated electronic toy ball for use in an electronic toy system according to claim 1, comprising: infrared light emitters arranged spatially within the ball to emit infrared light to its surroundings, and wherein said emitters are switched on and off sequentially; wherein said infrared light emitters are arranged at mutually different angles to emit light from the ball in all directions.

By turning the infrared light emitters on and off sequentially the effective radiation range of the toy ball is extended. In fact the battery is capable of supplying a larger electrical current through each emitter when only one or a few emitters are switched on at a time. By switching the emitters on and off sufficiently fast it is ensured that light is emitted in all directions even though the ball rotates. This aspect is particularly important in toys since light detectors with a great sensitivity are too expensive for use in toys.

In a third aspect, the invention relates to a toy system, comprising a toy element, and a play face with a light reflection varying structurally over the play face; said is toy element comprising: motor means coupled to move the toy element; a first light detector arranged to detect infrared light emitted towards the toy element from a unit on the play face; a second light detector arranged to detect light reflection of the play face; and a control unit arranged to receive from said detectors signals representative of influx of infrared light on the first light detector, and influx of light on the second light detector; wherein said control unit is capable of executing a program to: control the motor means to navigate the toy element on the play face in response to signals responsive to infrared light; control the motor means to navigate the toy element on the play face in response to signals responsive to light reflection of the play face.

Consequently, a user makes a programme to navigate the toy both with respect to other toy elements emitting infrared light and with respect to a position on the play face.

BRIEF DESCRIPTION OF THE DRAWING

The invention will be explained more fully below in connection with a preferred embodiment and with reference to the drawing, in which.

DETAILED DESCRIPTION OF A PREFERRED EMBODIMENT

Figure 1:
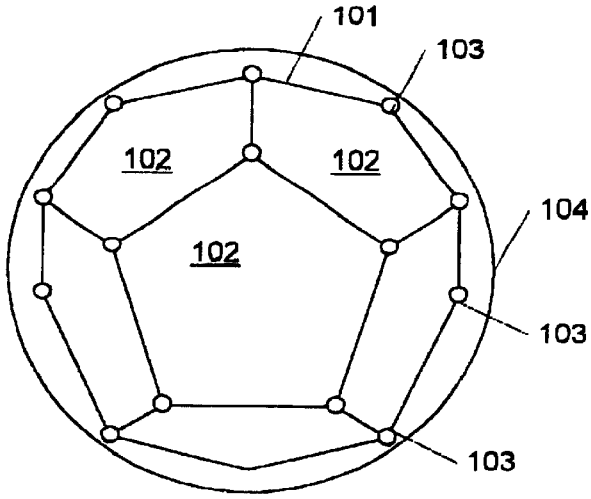
FIG. 1 shows a toy element on a play face.

FIG. 1 shows a toy ball in a first embodiment. The toy ball is configured as a grid 101, composed of pentagons 102, within a transparent plastics sphere 104. Infrared light emitting diodes 103 are placed at nodes of the grid 101. When the infrared light emitting diodes are powered properly, the toy ball emits infrared light to its surroundings and in all directions.

Figure 2:
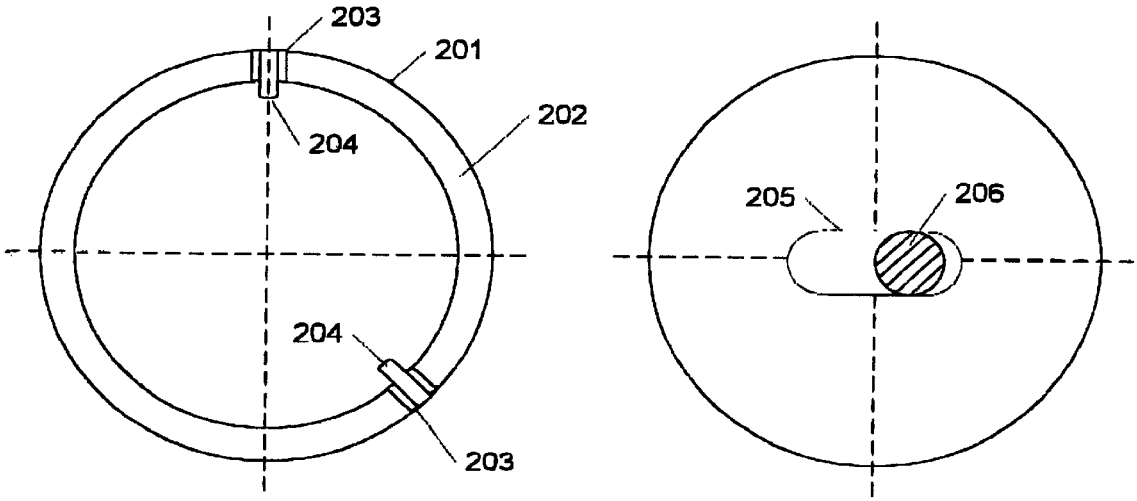
FIG. 2 shows a toy ball in a first embodiment.

FIG. 2 shows a cross-sectional view of a toy ball in a second embodiment. In this embodiment the ball is configured as a non-transparent sphere 201 with a sphere wall 202. The sphere wall has holes 203 for accommodating infrared light diodes 204 to emit infrared light to the surroundings of the ball. Thereby the toy ball can be manufactured as two moulded semi-spheres with holes. Subsequently, infrared light diodes can be mounted in the holes of the two semi-spheres. Thereafter, electronic circuitry and battery for powering the light diodes can be mounted in one of the semi-spheres to be attached to the other one of the semi-spheres e.g. by welding or gluing the two semi-spheres together.

The sphere 201 may be configured with a hollow space 205 within which a movable or displaceable weight 206 e.g. in the form of a sphere can be placed. This weight 206 will thus move when the toy ball is rotated and consequently result in a non-homogenous or 'unpredictable' rotation/ movement of the toy ball. Alternatively, the weight may be held in a fixed position in the ball displaced from the centre of the toy ball.

Further, it is preferred that the sphere 201 is configured with an electrical terminal for charging a rechargeable battery in the sphere from an external battery charger without detaching parts e.g. semi-spheres of the sphere.

Generally, it should be noted that the ball is to used in conjunction with very slowly moving toy robots, resulting in an expected rotation frequency less than 10 rotations per second.

Figure 3:
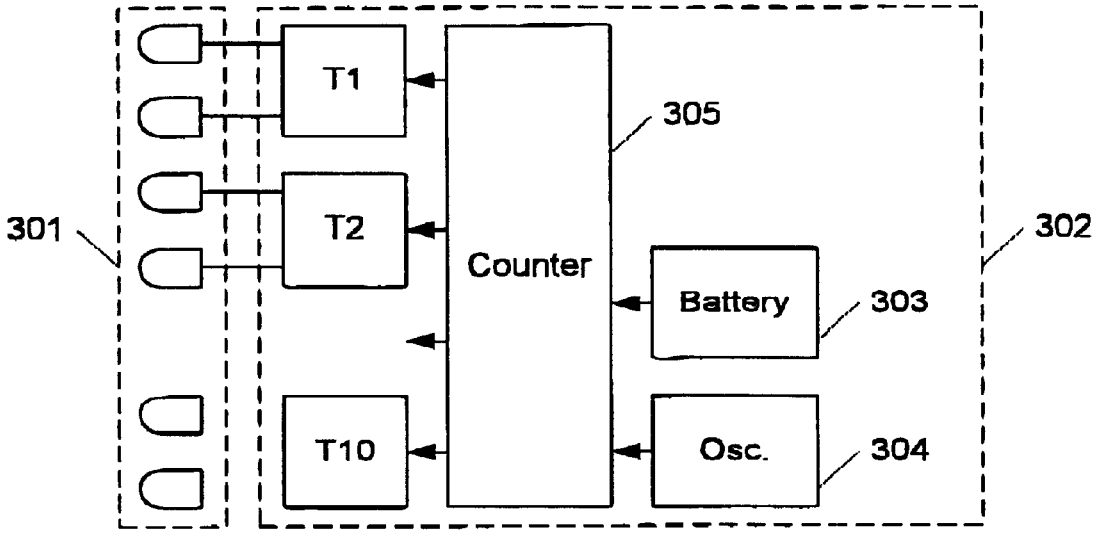
FIG. 3 shows a cross-sectional view of a toy ball in a second embodiment.

FIG. 3 shows a circuit diagram for a toy ball. As a consequence of the desire to reduce manufacturing costs of toy products, infrared sensors used in toy elements typically have a relatively poor sensitivity. Therefore, it is of major importance that infrared light emitters emitting light to be detected by a toy element are powered to ensure a maximum light radiation intensity.

A circuit 302 is configured to power a number of light emitting diodes 301. The circuit comprises a battery 303 for supplying electrical power to the circuit 302 and the light emitters 301. An oscillator 304 is configured to provide an oscillator signal supplied to a clock input terminal of a decade counter 305.

In response thereto the counter counts the number of pulses supplied at the clock input terminal. This count is provided as a base-10 number on binary output terminals, turning the light emitters on and off sequentially. The counter is buffered by means of drivers T1, T2, . . . T10. Each driver supplies power to one or more light diodes 301.

The oscillator signal contains pulses at a repetition frequency of e.g. 1KHz. However, the important criterion is that the emitters are switched on and off sequentially at a repetition frequency that exceeds a rotational frequency of the ball. This ensures that light is emitted in substantially all directions even though the ball rotates.

Thereby, the battery is loaded with only a few e.g. two light emitting diodes at any given time instead of being loaded with all the light emitting diodes e.g. 20 diodes. This in turn makes it possible to power the diodes with a relatively high current, resulting in a high light emitting intensity from any of the emitters.

Since it is expected that the ball is rotated relatively slowly and since the light emitters are switched on and off relatively fast, it is certain that a detector on another toy detecting infrared light will detect the emitted infrared light.

Thereby a limited amount of battery power is utilized very efficiently to emit infrared light at an intensity that can be detected over a long distance e.g. up to 2–3 metres from the ball.

It should be noted that the electronic circuit 302 is mounted inside the sphere 104 or 201.

Figure 4:
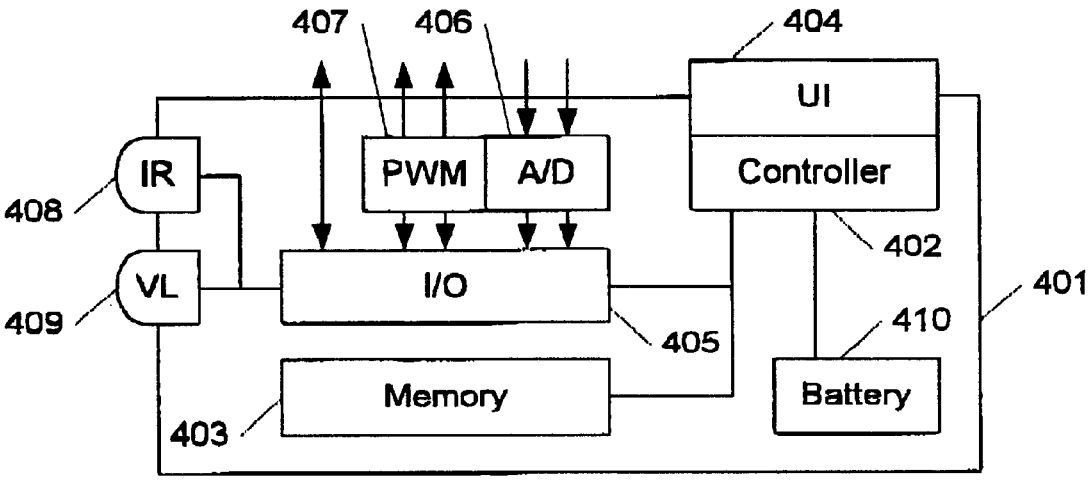
FIG. 4 shows a circuit diagram for a toy ball.

FIG. 4 shows a block diagram of a toy element. This toy element 401 is capable of detecting both visible light and infrared light and is also capable of detecting a collision activating a switch. This is used to provide input signals to a controller 402 capable of executing a program for manoeuvring the toy element 401 by providing output signals to e.g. an electromotor.

The toy element comprises a user interface 404 for operating the toy element, a controller 402 for executing programs stored in a memory 403, an input/output device 405, and a battery for powering the toy element. The input/output device is connected to an analogue-to-digital converter 406 for detecting an analogue signal and providing it to the controller 402, a visible light detector 409, an infrared light detector, and a binary input for detecting activation of a switch (not shown). In order to manoeuvre the toy element the input/output device is further connected to pulse-width-modulator output means 407 capable of driving e.g. an electro-motor. The toy element is powered by a battery 410.

In a preferred embodiment a relatively slow controller 402 is used, being busy with running manoeuvring programs, reading and updating the user interface, managing input/output from/to the I/O device 405, etc. As consequence of that, the infrared light detector 408 is read or sampled relatively slowly. In order to ensure a more reliable detection of infrared light from the switched emitters in the toy ball an average of multiple e.g. 3 samples from the light detector is used in the detection of the toy ball.

In another preferred embodiment either one of the infrared light detector 408 or the visible light detector 409 may also be arranged to be capable of receiving program data from a programming station e.g. via a visible light link in the form of an optical fibre. An electronic switch in the toy element 401 can be arranged to toggle to receive data from one of the light detectors 408, 409 when presence of a relatively high frequent data carrier in a detected light signal is detected. The switch will toggle back to detect light reflection from the surroundings when no carrier is detected over a time interval of e.g. 5 seconds. Thereby very simple down-loading of programs to the toy element is achieved.

Figure 5:
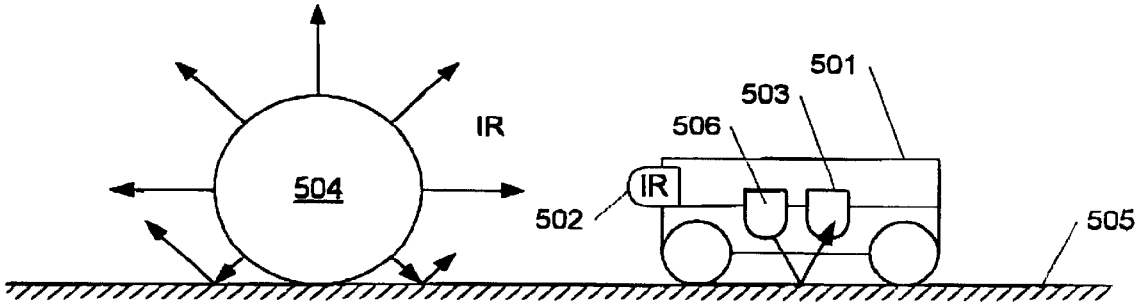
FIG. 5 shows a block diagram for a toy element.

FIG. 5 shows a toy element on a play face. The toy element 501 is configured with two types of light detectors; an infrared light detector 502 and a visible light detector 503. The infrared light detector is arranged to detect infrared light emitted from another toy element e.g. a toy ball 504. The visible light detector is arranged to detect visible light reflected from a play face 505.

In a preferred embodiment the toy element further comprises a visible light source 506 radiating visible light onto the play face for subsequent reflection and detection by the visible light detector 503. Consequently, a more reliable measure of the amount of light reflected from the play face is obtained since the effect of background light can be diminished.

Figure 6:
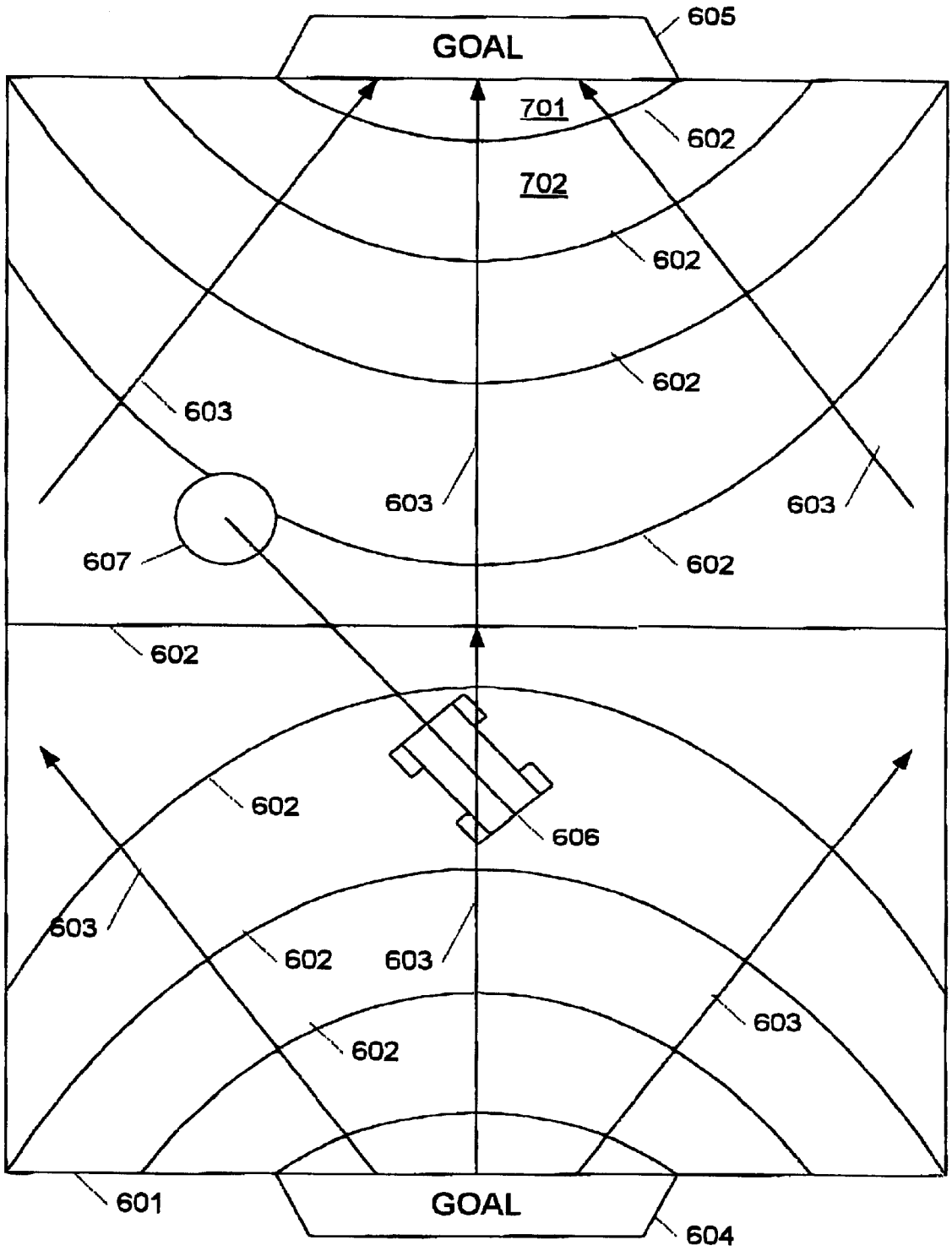
FIG. 6 is a top view of a play face.

FIG. 6 is a top view of a play face. The flay face 601 has a plane surface in coloured or grey tones.

The tones vary structurally across the play face as indicated by lines 602, where each line represents a given tone intensity. Further, the tones vary in a monotonic way in directions as indicated by arrows 603. The arrows 603 thus represents tone gradients across the play face.

It is thus possible to measure the light reflection of a spot on the play face underneath a programmable toy vehicle 606, program the toy to move towards a greater or smaller light reflection, and consequently make the toy vehicle move towards either one of the goals 604 or 605.

In a preferred embodiment this navigation strategy is further developed to, firstly, move the toy vehicle towards an infrared light emitting toy ball 607, and, secondly, move the toy vehicle towards either one of the goals 604 or 605—carrying, gripping, or pushing the toy ball towards either one of the goals 604 or 605. Thereby a simple soccer player toy is created.

Thereby, the play face in conjunction with a light detector for registering the light reflection of the play face can be used as a simple positioning system.

It should be noted that other patterns for varying the tones or light reflection of the play face can be used, e.g. comprising paths and branches. Moreover, the play face can be arranged to accommodate obstacles.

In a preferred embodiment the play face is in the form of a paper or plastics sheet, or a blanket that can be rolled or folded for easy and compact transportation.

Figure 7:
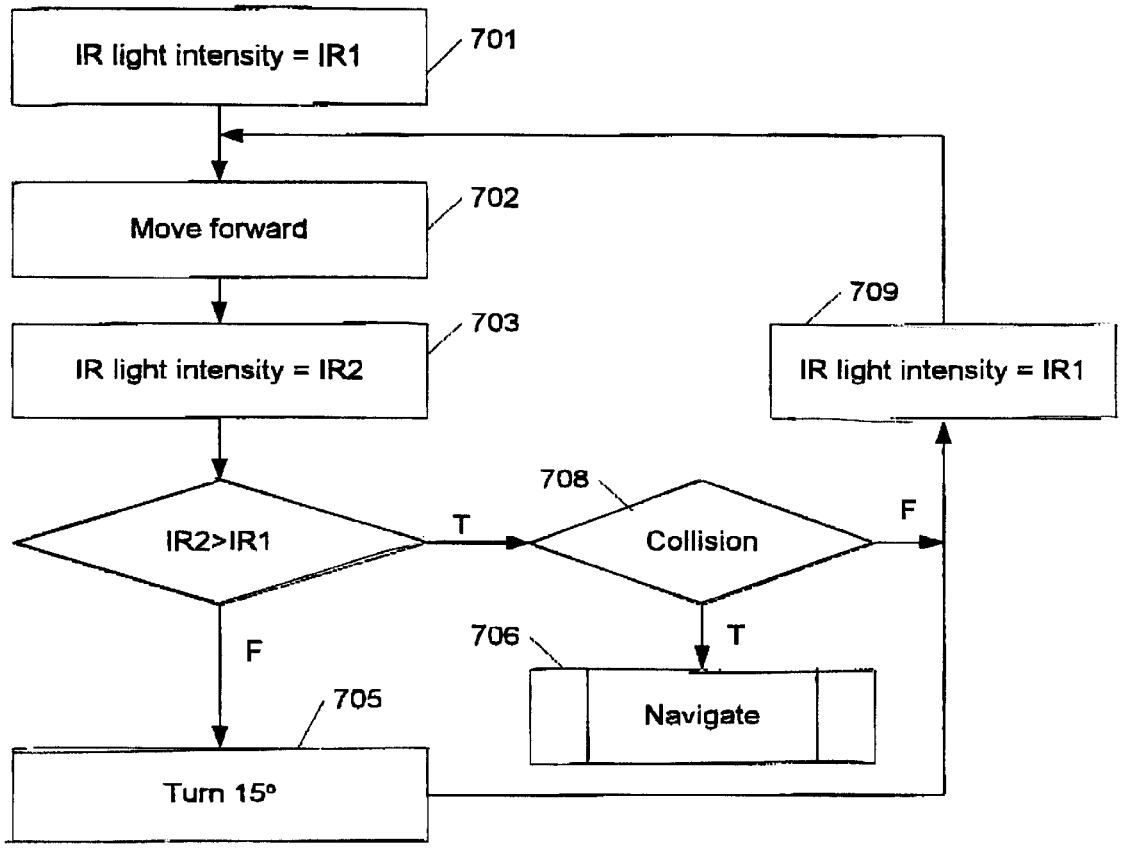
FIG. 7 shows a flowchart for a program of manoeuvring a toy element.
Figure 8:
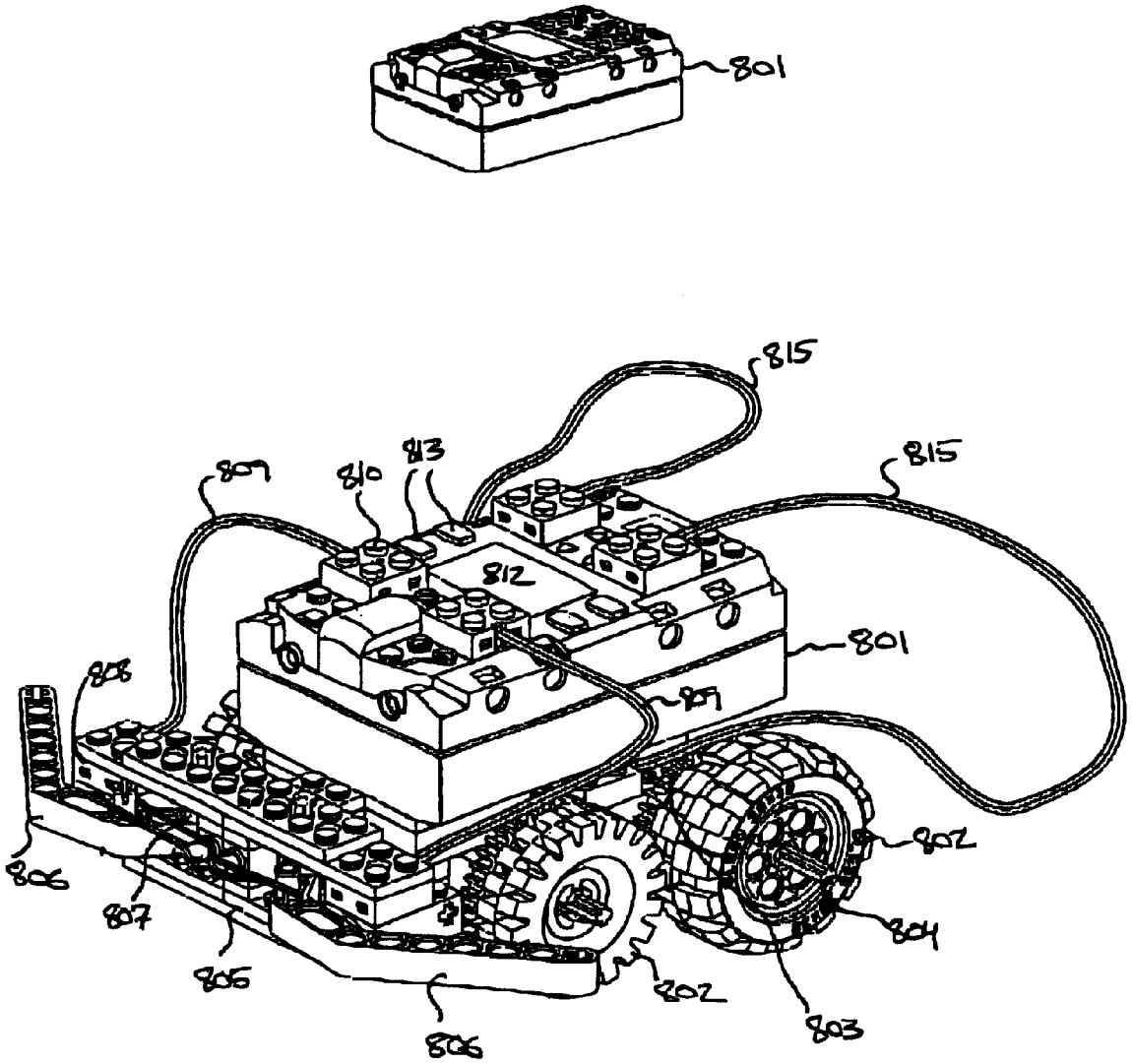
FIG. 8 shows a toy element with means for moving around.

FIG. 7 shows a flowchart for a program of manoeuvring a toy element. The program can be stored in the memory 403 of the toy element 401 configured with manoeuvring and detecting means as shown in FIGS. 5 or 8.

In step 701 the infrared light intensity at the current position of the toy vehicle is registered as the light intensity IR1. However, in order to determine in which direction to move the toy, the toy in step 702 is programmed to move a short distance in a start direction, which can be any direction. Subsequently, at the new position, the infrared light intensity is registered as the light intensity IR2 in step 703.

In step 704 it is verified whether IR2 is greater than IR1. If this is false (F) the start direction, apparently, did not move the toy vehicle towards a larger infrared source e.g. the ball 504. Therefore, in step 705, the toy is turned e.g. 15° to examine a direction rotated 15° relative to the start direction. In step 709 the infrared light intensity is measured again as IR1 and the program will return to step 702 to move forward, measure IR2 and verify again.

Alternatively, if the verification in step 704 is true (T) i.e. IR2 is greater than IR1, it is verified whether a collision is detected. If this is the case (Y), the program will call a sub-procedure for navigating the toy towards e.g. an increasing light reflection of the play face. Alternatively, i.e. no collision is detected, the infrared light intensity is measured in step 709 and the program is looped back to step 702 to verify whether the toy element can continue in the current direction.

The navigate sub-procedure can be implemented in different ways. In a preferred way the sub-procedure follows a program flow as outlined above wherein the measurement of infrared light intensity in steps 701, 703, and 709 is replaced by with measurements of visible light reflection from the play face.

Consequently, the toy vehicle is programmed to behave as a simple soccer player on the play face 601.

FIG. 8 shows a toy structure comprising a microprocessor controlled toy building element coupled together with generally known toy building elements to provide a toy element with means for moving around. The microprocessor controlled toy building element 801 is coupled on top of a structure 805 of building elements and two motors (not shown). The motors drive a wheel at each side of the vehicle, of which only the wheel 802 on one side of the toy structure is visible. The wheels are driven by a shaft 804 which is connected with the motor via gear wheels 803. The motors are electrically connected to the toy building element 801 by means of wires 815.

The toy structure moreover comprises two movable arms 806 which are pivotable about a bearing 807 so that the arms, when being pivoted, can be caused to affect a set of switches 808. The switches 808 are electrically connected to the toy element 801 via wires 809.

The toy element may be operated via the keys 813. The display 812 can show information, as described above in connection with FIG. 2. The toy element 801 has a set of electrical contact faces 810 and 811 to which the wires 809 and 815 may be connected for receiving signals and emitting signals, respectively.

By suitable programming of the toy element 801 the vehicle may be caused to drive round obstacles that may affect the arms 806.

What is claimed is:

1. An electronic toy system comprising:

a first toy element arranged to emit infrared light produced by an infrared light emitter to its surroundings;

a play face on which the toy element can be placed to move and which has a light reflection varying spatially over the play face with a light reflection gradient directed towards a target on the play face;

a second toy element with means for moving the second toy element, a first infrared light detector arranged to detect infrared light emitted from the first toy element, a second detector arranged to detect light reflection of a spot on the play face, and a control unit coupled to the detectors; wherein the control unit is arranged to control movement of the second toy element on the play face in response to input from the first infrared light detector and the second detector.

2. An electronic toy system according to claim 1, wherein the first toy element comprises infrared light emitters arranged at different angles to emit light from the first toy element in all directions.

3. An electronic toy system according to claim 1, wherein the first toy element comprises infrared light emitters organized in groups, wherein the emitters are turned on and off sequentially group-by-group by means of respective pulsed electrical signals provided by a timing circuit.

4. An electronic toy system according to claim 3, wherein the pulsed electrical signal contains pulses with a relatively high repetition rate in comparison with a rotational frequency of the first toy element.

5. An electronic toy system according to claim 1, wherein the first infrared detector is sampled at a relatively low repetition rate; and wherein sampled values are integrated and supplied to the control unit as a measure of infrared light intensity.

6. An electronic toy system according to claim 1, wherein the light emitted by the infrared light emitter has a maximum light intensity within a wavelength range where the first infrared detector has a maximum sensitivity to light.

7. An electronic toy system according to claim 1, wherein the first toy element is battery-powered by a battery inside the first toy element.

8. An electronic toy system according to claim 1, wherein the second toy element is a toy building element comprising coupling means for interconnection with other toy building elements provided with complementary coupling means.

9. An electronic toy system according to claim 1, wherein one or more of the light detectors among said light detectors are further capable of receiving data for programming the second toy element from a programming station.

10. An electronic toy system according to claim 1, wherein the means for moving the second toy element comprise an electromotor driving a wheel.

11. An electronic toy system according to claim 1, wherein said first toy element is spherical and the toy system is configured to resemble a soccer game containing one or more goal elements.

12. A battery-operated electronic toy ball for use in an electronic toy system according to claim 1, comprising:

infrared light emitters arranged spatially within the ball to emit infrared light to its surroundings, and wherein said infrared light emitters are turned on and off sequentially at a repetition frequency that exceeds a rotational frequency of the ball; wherein said infrared light emitters are arranged at different angles to emit light from the ball in all directions.

13. An electronic toy system according to claim 12, wherein the infrared light emitters are powered with said pulsed electrical signals that have a pulse power that exceeds a nominal power value for the pulse power of said infrared light emitters.

14. An electronic toy system according to claim 12, wherein the infrared light emitters are infrared light emitting diodes emitting light at wavelengths of from 800 to 1000 nanometres.

15. An electronic toy system according to claim 12, wherein the diodes are mounted at the nodes of a spatial grid construction.

16. An electronic toy system according to claim 12, wherein the diodes are mounted at the nodes of a spatial grid construction composed of pentagons.

17. An electronic toy system according to claim 12, wherein the toy ball is weight-balanced with a centre of gravity coincident with the centre of the ball.

18. An electronic toy system according to claim 12, wherein the toy ball is weight-balanced with a centre of gravity displaced from the centre of the ball.

19. An electronic toy system according to claim 12, wherein the toy ball is weight-balanced with a weight movable within a hollow space of the ball.

20. An electronic toy system according to claim 12, wherein the ball has a diameter between 3 centimetres and 10 centimetres.

21. A toy system, comprising a toy element and a play face on which the toy element can be placed to move and with a light reflection varying spatially over the play face with a light reflection gradient directed towards a target on the play face; said toy element comprising:

a motor coupled to move the toy element;

a first light detector arranged to detect infrared light emitted towards the toy element from a unit on the play face;

a second light detector arranged to detect light reflection of the play face; and a control unit arranged to receive from said detectors signals representative of influx of infrared light on the first light detector, and influx of light on the second light detector;

wherein said control unit is capable of executing a program to:

control the motor to navigate the toy element on the play face in response to signals generated as a response to infrared light received by the first infrared light detector;

control the motor to navigate the toy element on the play face in response to signals generated as a response to light reflected on the play face and received by the second light detector.

22. A toy system according to claim 21, wherein the light reflection of the play face is varied in visible grey tones.

23. A toy system according to claim 21, wherein the light reflection of the play face is varied in visible coloured tones.

24. A toy system according to claim 23, wherein the second light detector comprises a colour filter matching a colour on the play face.

25. A toy system according to claim 21, wherein said unit is an electronic toy comprising: infrared light emitters arranged spatially within the unit to emit infrared light from the unit to the surroundings of the unit; wherein said infrared light emitters are arranged at different angles to emit light from the unit in all directions.

26. A toy system according to claim 21, wherein said toy element comprises a collision detector susceptible to collision between said toy element and said unit; and wherein said program is further capable of controlling the motors to navigate the toy element in response to a detection of a collision.

* * * * *